US007401787B1

(12) United States Patent
Conte et al.

(10) Patent No.: US 7,401,787 B1
(45) Date of Patent: Jul. 22, 2008

(54) INFLATABLE COMBAT ARENA GAME

(76) Inventors: Juan Conte, 400 E. Colonial Dr. # 602, Orlando, FL (US) 32803; Sergio D. Galdo, Municca 1660, Castelar, BS AS (AR) B1712BGH; Fernando R. Orbelli, Av. Rosales 2317, Haedo, BS. AS (AR) 1706

( * ) Notice: Subject to any disclaimer, the term of this patent is extended or adjusted under 35 U.S.C. 154(b) by 0 days.

(21) Appl. No.: 11/273,587

(22) Filed: Nov. 14, 2005

Related U.S. Application Data

(60) Provisional application No. 60/627,351, filed on Nov. 12, 2004.

(51) Int. Cl.
*A63F 9/00* (2006.01)

(52) U.S. Cl. ..... 273/458; 273/440; 273/444; 273/457; 273/459

(58) Field of Classification Search ..... 273/440, 273/440.1, 457, 458, 444, 459; 473/415; 446/28, 220; 472/92, 94, 134, 137; 2/DIG. 3; D21/835
See application file for complete search history.

(56) References Cited

U.S. PATENT DOCUMENTS 3,759,515 A * 9/1973 Crooks ..... 273/440
3,801,093 A * 4/1974 Jones, III ..... 472/94
3,930,667 A 1/1976 Osuchowski et al.
3,972,526 A * 8/1976 Cox, Jr. ..... 446/28
4,062,079 A 12/1977 Potter
4,078,842 A 3/1978 Zur
4,136,402 A 1/1979 Insulan et al.
4,230,097 A 10/1980 Beaussant et al.
4,310,927 A * 1/1982 DeBose ..... 2/115
4,432,101 A 2/1984 Johnson
4,437,628 A 3/1984 Schwartz
4,498,881 A 2/1985 Buckle
4,533,099 A 8/1985 Stewart
4,638,791 A 1/1987 Krogh et al.
4,674,479 A 6/1987 Jennings et al.
4,862,517 A 9/1989 Meistrell
4,881,539 A 11/1989 Pasternack
4,941,877 A 7/1990 Montano, Jr.
4,957,485 A 9/1990 Andersson et al.
4,965,886 A 10/1990 Ockels
4,977,623 A 12/1990 DeMarco
5,041,125 A 8/1991 Montano, Jr.
5,067,921 A 11/1991 Bramham
5,186,675 A 2/1993 Stoddard
5,191,658 A 3/1993 Meistrell
5,219,309 A * 6/1993 Hart ..... 441/136
5,318,481 A 6/1994 St-Germain
5,335,382 A 8/1994 Huang
5,347,656 A 9/1994 Fabritz et al.

(Continued)

OTHER PUBLICATIONS

Rewacowicz, Ana, Inflatable Museum, downloaded from www.kissmachine.org.

*Primary Examiner*—Raleigh W. Chiu
(74) *Attorney, Agent, or Firm*—Allen, Dyer, Doppelt, Milbrath & Gilchrist, P.A.

(57) ABSTRACT

A combat game includes an inflatable arena, one or more inflatable player suits in fluid connection with said inflatable arena and at least one source of air in fluid connection with said inflatable arena and said one or more inflatable player suits, said at least one source of air capable of providing a flow of air under positive pressure.

7 Claims, 5 Drawing Sheets

U.S. PATENT DOCUMENTS 5,400,529 A 3/1995 Bell et al.
5,419,612 A 5/1995 Rassekhi
5,558,395 A 9/1996 Huang
5,566,935 A 10/1996 Meharg
5,580,132 A 12/1996 Rediske
5,720,678 A * 2/1998 Korthauer ..... 473/415
5,755,756 A 5/1998 Freedman, Jr. et al.
5,772,535 A * 6/1998 Murphy ..... 473/415
5,860,162 A 1/1999 Love
5,941,272 A 8/1999 Feldman
6,014,784 A 1/2000 Taylor et al.
6,296,580 B1 * 10/2001 Hamet ..... 473/415
D462,145 S 8/2002 Abzakh
6,551,160 B1 4/2003 Toth et al.
6,629,942 B1 10/2003 Tubbs
6,701,920 B1 3/2004 Cox
6,854,459 B1 2/2005 Cox
6,875,119 B2 * 4/2005 Murphy et al. ..... 472/134
6,962,534 B2 * 11/2005 Richter et al. ..... 472/90

* cited by examiner

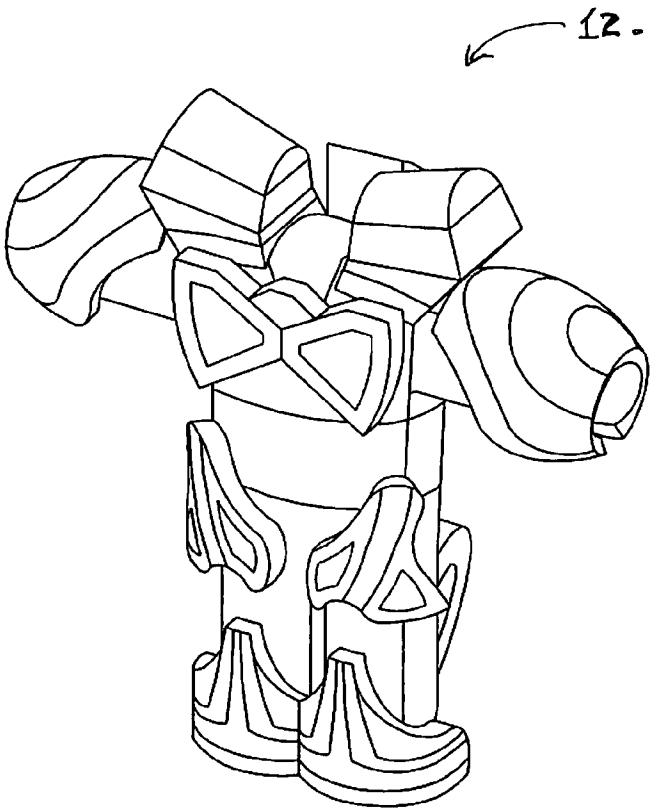
Fig. 1.
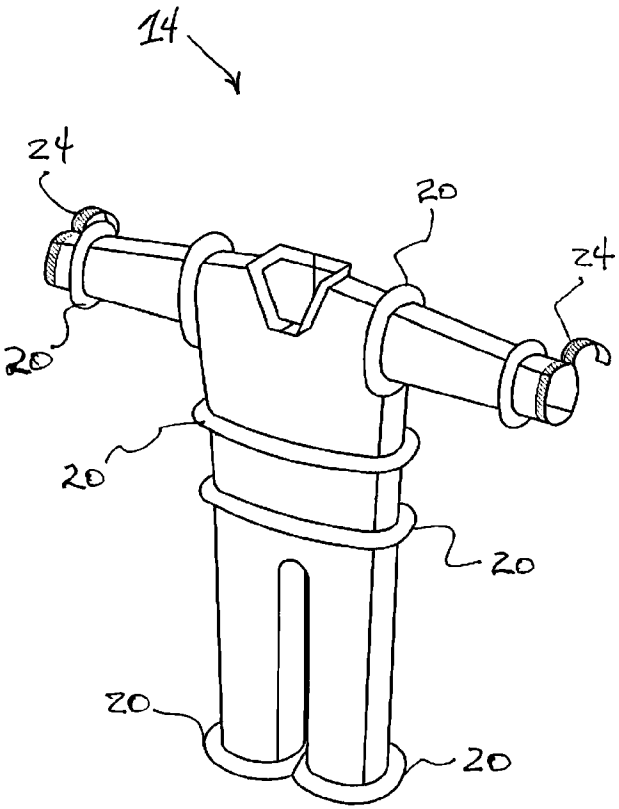

INFLATABLE COMBAT ARENA GAME

RELATED APPLICATION

This application is related to and claims priority from now abandoned provisional application Ser. No. 60/627,351, which was filed on Nov. 12, 2004, and which is incorporated herein by reference in its entirety.

FIELD OF THE INVENTION

This invention relates to inflatable games and amusements and, more specifically, to a combat game including an inflatable battle dress in combination with an inflatable arena.

BACKGROUND

Air-filled games which must be inflated with an air compressor have become very popular attractions in carnivals, festivals, neighborhood celebrations, and even for children's parties. These inflatable amusements are usually group activities such as houses that children may crawl through, inflatable trampolines, and the like. Typically, these inflatable games and amusements are not directed to individual performance by two participants engaged in hand to hand combat, albeit in play.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which:

FIG. 1 is a front perspective view of an inflatable combat suit according to an embodiment of the present invention, wherein FIG. 1A is the interior suit and FIG. 1B is the exterior suit;

FIG. 2 includes back perspective views of the exterior combat suit in open and closed configurations, wherein FIG. 2A is the suit open and FIG. 2B is the suit closed;

DETAILED DESCRIPTION OF THE PREFERRED EMBODIMENTS

The present invention will now be described more fully hereinafter, in which description preferred embodiments of the invention are discussed. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from FIGS. 1-7, which illustrate various aspects of the present invention.

Figure 2:
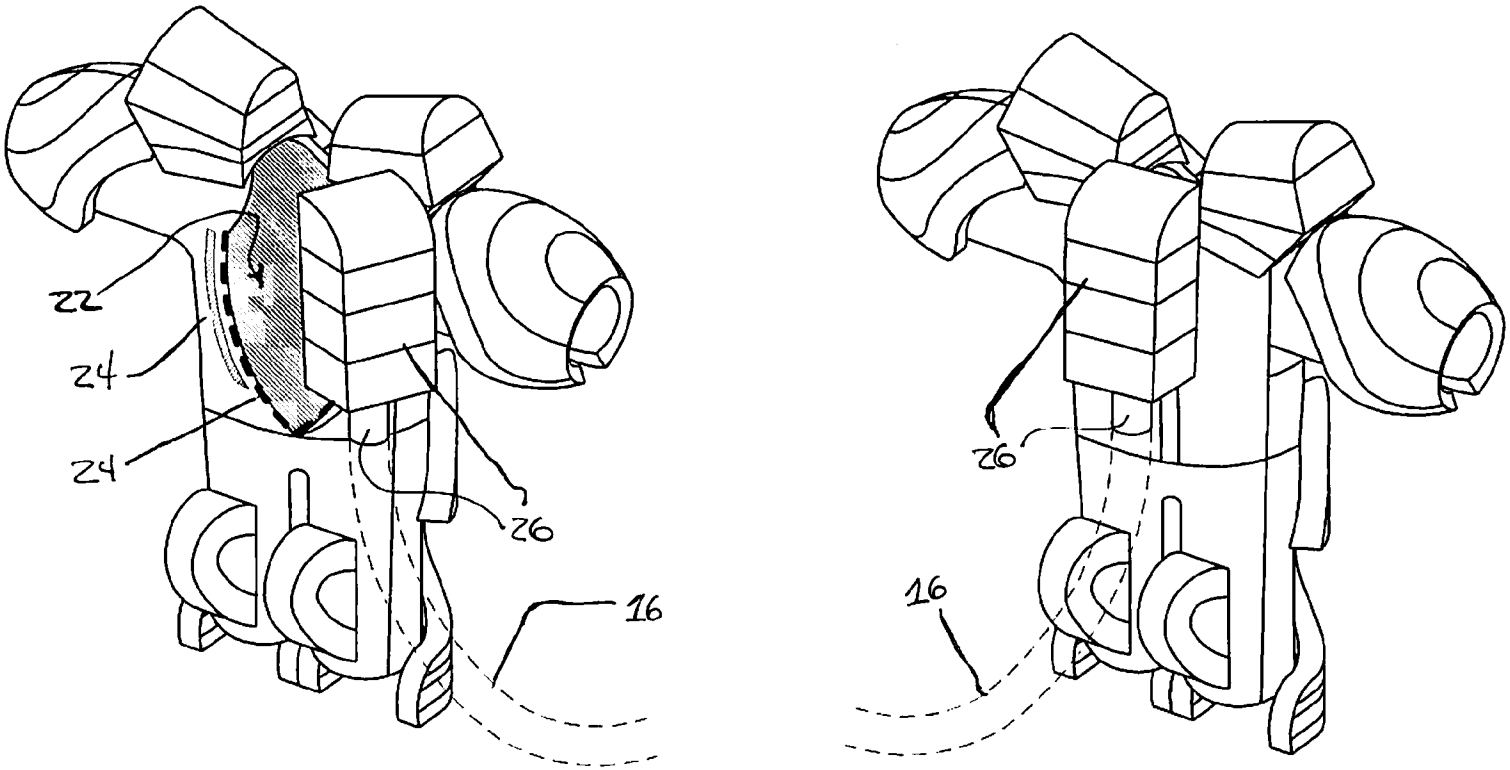
Figure 3:
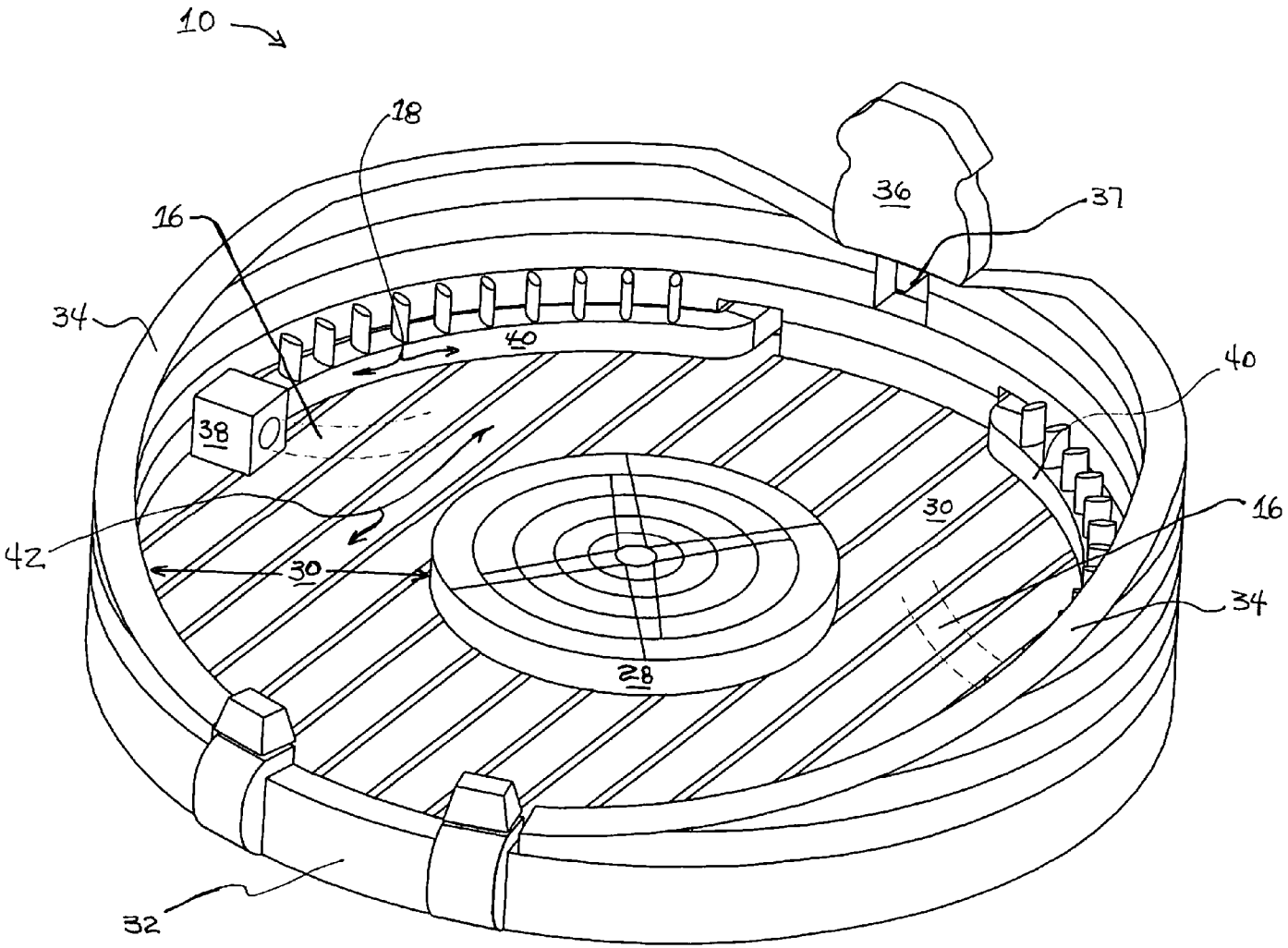
FIG. 3 shows a perspective view of the inflatable combat arena of the present invention.
Figure 4:
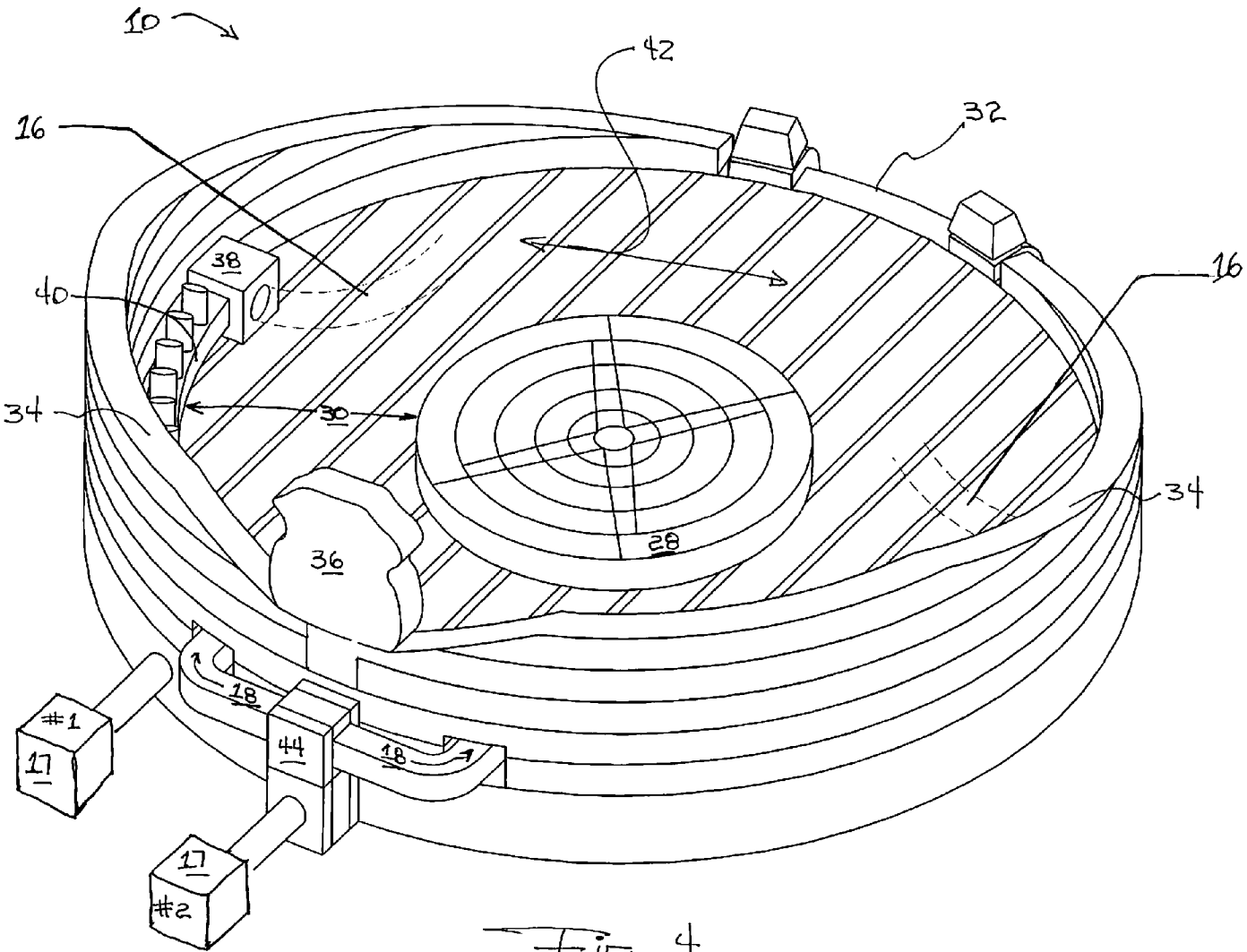
FIG. 4 depicts a second perspective view of the combat arena of FIG. 3.
Figure 5:
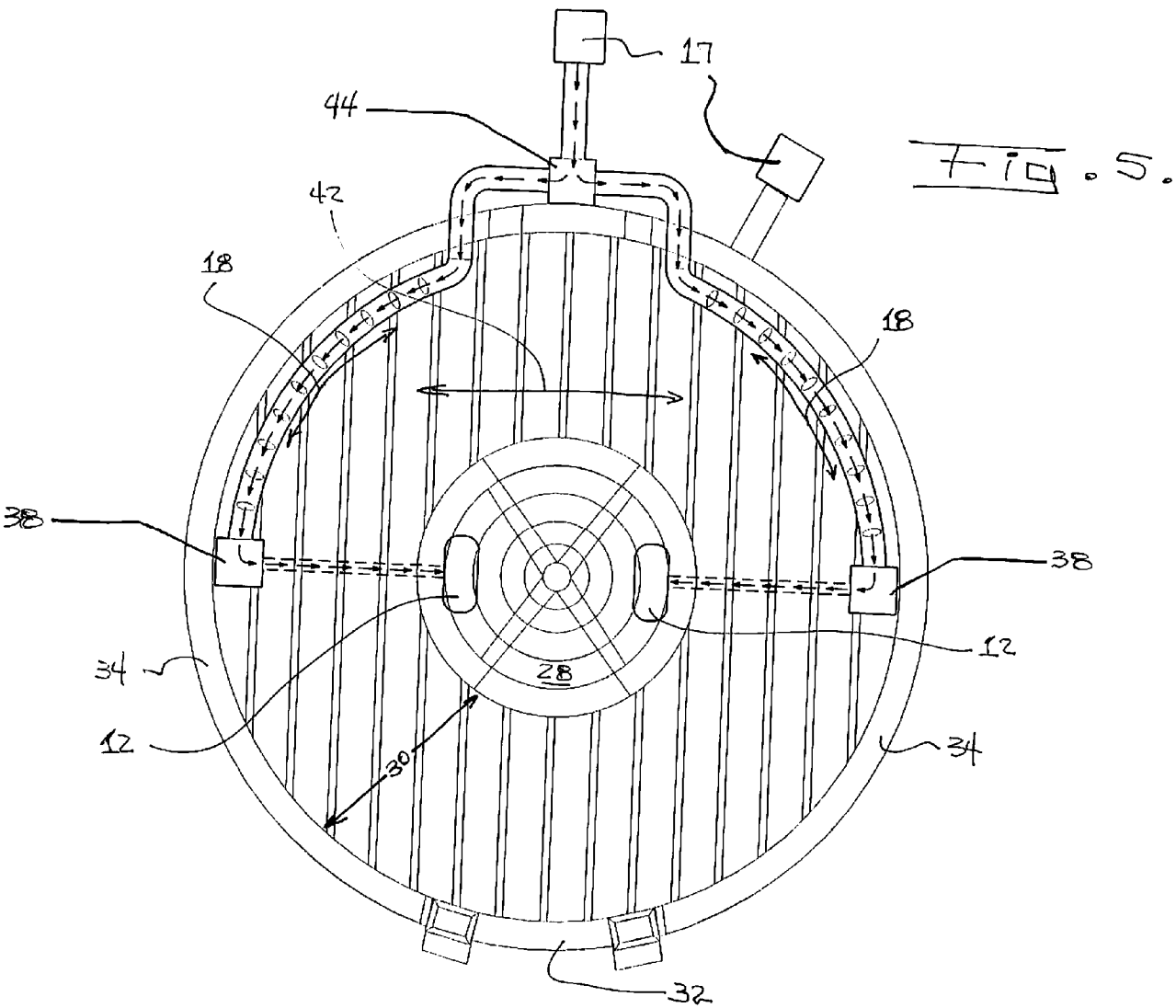
FIG. 5 is a diagram illustrating the air distribution system in the combat arena to deliver air under positive pressure to the combat suits.

The invention includes an inflatable combat arena 10 and preferably two inflatable combat suits 12 for players in the game. FIGS. 1-5 depict various details of the combat arena and combat suits. As best shown in FIG. 1, the inflatable combat suit 12 comprises an interior suit 14 and an exterior suit 12. The interior suit 14 is worn by the player preferably directly against the skin or alternatively over the player's clothing. Once wearing the interior suit 14, the player steps into and puts on the exterior suit 12 portion of the combat outfit. Air is pumped under positive pressure through an air hose 16 connected to the back of the suit's outer layer 12, so that it fills the suit by accumulating and circulating between the inner and outer layers. The inflated suit 12 acts to provide protection for the player during the combat game. The suits are connected to an air blower 17 which pumps air to the suits through a distribution system 18 as shown in FIGS. 3-5.

The inflatable combat suits 12 will now be described with specific reference to FIGS. 1 and 2. The combat suit preferably consists of an interior suit and an exterior suit. An example of an interior suit 14 is shown in FIG. 1A. The interior suit 14 as shown in FIG. 1A includes certain portions which resemble O-rings 20 and which protrude outwardly from the primary surface of the suit. The illustration, for example, shows these O-rings 20 positioned along the arms, torso and waist, and lower legs of the suit 14. These O-rings 20 help in maintaining spacing between the interior suit 14 and the exterior suit 12, an example of which is shown in FIG. 1B in front perspective view. As also shown in FIGS. 2A and 2B, the exterior suit 12 includes an opening 22 which may be closed by means of a zipper, of a hook and loop (Velcro®) closure 24 or both. As noted above, the opening 22 serves for the player to enter the suit 12 prior to beginning the game. The exterior suit 12 includes an inlet connection 26 for an air hose 16 which conveys air under positive pressure from a blower 17, as shown in FIGS. 4 and 5. As further described below, the outward design appearance of the exterior suit may take many forms.

The combat arena 10 comprises a combat platform 28 positioned approximately in the center of the preferably circular arena. Surrounding the combat platform 28 is a generally wide area or safety zone 30. The entire arena 10 device is also inflated by an air blower 17 which may be the same blower as used for the suits 12 but, preferably, is a separate additional blower, as shown in FIG. 4. Having two separate blowers 17 helps ensure that both the arena platform 28 and the suits 12 remain properly inflated during the combat game and, thus, helps assure adequate protection for the players. Additionally, providing a means of inflating the combat suits 12 independently from the arena 10 allows the players to put on the suits in a deflated state while the arena has been previously inflated.

FIGS. 3-5 provide various views of an example of the inflatable arena 10 of the present invention. FIG. 3 shows a front perspective view of the arena, wherein towards the front of the arena two columns indicate an area which may serve as an ingress gate 32. A containment barrier or wall 34 extends along the periphery of the arena and, as shown in FIGS. 3 and 4, preferably increases in height from the ingress area to the rear of the arena 10, where a display space 36 and a sound source 37 may be positioned. Air hose connection boxes 38 are preferably located adjacent the containment wall 34 and are preferably positioned so that there is one box in each player's area, that is, the connection boxes are generally opposite each other, as most easily seen in FIG. 5. A combat platform 28 is positioned generally centrally in the arena 10 and is surrounded by a safety zone 30 which acts as a buffer between the combat platform and the containment wall 34. An air conduit 40 extends to each air hose connection box 38, bringing air under positive pressure from a blower 17, as shown in FIGS. 4 and 5. Thereafter, an air hose 16 extends from the air hose connection box 38 to a player's inflatable suit. An inflatable base 42 provides support for the arena 10. FIG. 4 provides a rear perspective view of the inflatable arena 10 of FIG. 3, with the same components shown in opposite view. In FIG. 4, the blowers 17 are shown positioned along a rearward periphery of the inflatable arena 10. As can be appreciated from FIG. 4, the rearward periphery of the arena 10 includes structural features which would most hinder the presence of spectators in the area. Two blowers 17, as discussed above, are shown in FIG. 4 providing air under pressure for two player suits 12 and for the arena 10 itself. In this figure, blower #2 17 is shown connected to an air distribution box 44 which conveys the air under pressure to the two air conduits 18 shown in FIG. 3. Blower #1 17 is shown in FIG. 4 as providing air under pressure for the arena 10 itself. In the rear perspective view provided in FIG. 4 it can be appreciated that, preferably, the height of the containment barrier or wall 34 is more pronounced at the rear of the arena and less pronounced at the front of the arena. FIG. 5 provides a top plan view of the inflatable arena 10 and combat suits 12 in place for a contest.

The combat arena 10 and combat suits 12 herein described are best made of a strong, resilient plastic material which may be reinforced with one or more layers of another material. The material should be substantially impermeable to air, so that the game remains well inflated while in use. While the combat suits 12 are intended to be inflated, they are not necessarily completely air tight. Air leaks from the suits 12, however, will be quickly replenished by the continuous supply of air provided under at least slight positive pressure by the air blower 17 dedicated to the suits. The air hoses 16 which connect to the suits 12 may be of any suitable material and type, and are preferably sufficiently flexible to allow adequate mobility of the players around the arena.

As noted above and in FIG. 3, the inflatable arena 10 may include a sound source 37 which may be used to play music or to announce the combat game. Additionally, as shown in FIGS. 3 and 4, a display space 36 may be associated with the sound source 37. The display space may 44 serve as a location for positioning advertising indicia, for a scoreboard to keep track of points scored by a player during a combat game, or for combinations thereof.

Additionally, those skilled in the art will recognize that the particular aesthetic design of the arena 10 and the suits 12 may be varied according to many different themes, all of which are intended within the scope of the present application. For example, the arena 10 may be designed to appear as a futuristic stadium and the combat suits 12 may have the appearance of robots. In another example, the arena may be designed as a wrestling platform and the combat suits may be designed to look like Sumo wrestlers. In yet another example, the arena 10 may simulate a Roman circus and the suits 12 made to appear as gladiators of the time. In yet a further example, the arena 10 may be a jousting field and the suits 12 may simulate medieval knights in armor. Alternatively, one suit 12 could represent one type of combatant, while the other suit represents a traditional enemy or opponent of the first, for example, a Roman legionnaire against a hun, or a Saxon soldier against a Viking warrior, a bull vs. a bullfighter. The designs may further include fictional characters from the movies, television series, and the like. For example, from the well known television and film series StarTrek, Captain Kirk against the Gorn, or from another series, Batman against Riddler, or Superman against Lex Luthor. The skilled will understand that the design possibilities are endless.

In the specification there have been disclosed typical preferred embodiments of the invention, and although specific terms are employed, they are used in a descriptive sense only and not for purposes of limitation. The invention has been described in some detail, but it will be apparent that various modifications and changes can be made within the spirit and scope of the invention as described in the foregoing specification.

What is claimed is:

1. A game comprising:

one or more blowers providing air under positive pressure;

an arena having a game surface supported on a base containing air provided by said one or more blowers;

a containment barrier extending upwardly along at least a partial periphery of said arena; and one or more player suits connected to and at least partially filled with air by said one or more blowers.

2. A game comprising:

an arena at least partially filled with air;

a containment barrier extending upwardly along at least a partial periphery of said arena;

one or more player suits associated with said arena and at least partially filled with air; and at least one source of air in fluid connection with said arena and with said one or more player suits for providing air thereto.

3. A game comprising:

an inflatable arena;

one or more inflatable player suits in fluid connection with said inflatable arena; and at least one source of air in fluid connection with said inflatable arena and said one or more inflatable player suits, said at least one source of air capable of providing a flow of air under positive pressure.

4. The game of claim 3, further comprising a containment barrier positioned along a periphery of said arena.

5. The game of claim 3, further comprising a containment barrier positioned along a periphery of said arena and in fluid communication therewith.

6. The game of claim 3, further comprising a containment barrier positioned along a periphery of said arena, said containment barrier being at least partially inflatable.

7. The game of claim 3, wherein said one or more inflatable player suits comprise a first player suit designed to portray a first character and a second player suit designed to portray an enemy of the first character.

* * * * *